US007577378B2

(12) United States Patent
Matsui

(10) Patent No.: US 7,577,378 B2
(45) Date of Patent: Aug. 18, 2009

(54) IMAGE CARRIER UNIT AND IMAGE FORMING APPARATUS

(75) Inventor: Toshiyuki Matsui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 519 days.

(21) Appl. No.: 11/521,451

(22) Filed: Sep. 15, 2006

(65) Prior Publication Data

US 2007/0230997 A1 Oct. 4, 2007

(30) Foreign Application Priority Data

Mar. 30, 2006 (JP) ..... 2006-095124

(51) Int. Cl.
*G03G 21/18* (2006.01)

(52) U.S. Cl. ..... 399/115

(58) Field of Classification Search ..... 399/90, 399/111, 114, 115, 176
See application file for complete search history.

(56) References Cited

U.S. PATENT DOCUMENTS

| | | | | |
|---|---|---|---|---|
| 5,465,136 | A * | 11/1995 | Watanabe | 399/111 |
| 5,666,608 | A * | 9/1997 | Christensen | 399/176 |
| 5,697,020 | A * | 12/1997 | Sato et al. | 399/100 |
| 5,752,135 | A * | 5/1998 | Coffey et al. | 399/115 |
| 6,385,420 | B1 * | 5/2002 | Morioka | 399/174 |
| 6,665,507 | B1 * | 12/2003 | Hooper et al. | 399/110 |
| 6,681,089 | B2 * | 1/2004 | Dougherty | 399/111 |
| 6,810,221 | B1 * | 10/2004 | Meyer et al. | 399/90 |
| 2005/0238385 | A1 | 10/2005 | Kang et al. | |
| 2006/0165434 | A1 * | 7/2006 | Kim et al. | 399/111 |

FOREIGN PATENT DOCUMENTS

| | | | |
|---|---|---|---|
| AU | 2004202645 | | 7/2005 |
| JP | 06003977 | A * | 1/1994 |
| JP | 06202404 | A * | 7/1994 |
| JP | A-7-36257 | | 2/1995 |
| JP | A-2000-214661 | | 8/2000 |
| JP | A-2001-194977 | | 7/2001 |
| JP | A-2001-201914 | | 7/2001 |
| JP | A-2001-201915 | | 7/2001 |
| JP | A-2004-21264 | | 1/2004 |
| JP | A-2004-67726 | | 3/2004 |
| JP | A-2004-85695 | | 3/2004 |
| JP | A-2004-292488 | | 10/2004 |
| JP | A-2004-307715 | | 11/2004 |
| JP | A-2005-234439 | | 9/2005 |
| KR | 10-2006-0009208 | | 1/2006 |

* cited by examiner

*Primary Examiner*—Robert Beatty
(74) *Attorney, Agent, or Firm*—Morgan, Lewis & Bockius LLP

(57) ABSTRACT

An image carrier unit that is removably loaded into a main body of an image forming apparatus includes: an image carrier on which an image is formed; a charge roll that charges the image carrier; a biasing member that causes the charge roll to be pressed against the image carrier; and a separation cover provided with a cover portion that covers the charge roll by a latching portion thereof being caused to latch into a body frame of the image carrier unit and the cover portion being rotated toward the charge roll, and a hook portion disposed on the cover portion, that is inserted between the charge roll and the image carrier and is hooked onto the charge roll when the cover portion is rotated toward the charge roll so as to cause the charge roll to separate from the image carrier.

13 Claims, 12 Drawing Sheets

IMAGE CARRIER UNIT AND IMAGE FORMING APPARATUS

BACKGROUND

1. Technical Field

The present invention relates to an image forming apparatus such as a copier and a printer using electrophotographic system, and in particular relates to an image carrier unit that is removably loaded into an image forming apparatus and is provided with an image carrier such as a photoreceptor and a charge roll that charges a surface of the image carrier, and to an image forming apparatus provided with the image carrier unit.

2. Related Art

Conventionally, devices using the corona discharge phenomenon, such as scorotron chargers, have come to be widely used as charge devices in image forming apparatus such as copiers and printers using the electrophotographic system. But in the case of charge devices utilizing the corona discharge phenomenon, the generation of ozone and nitrogen oxide, which are harmful to humans and Earth's environment, is becoming a problem. In contrast, contact charging, where a conductive charge roll is brought into direct contact with a photoreceptor to charge the photoreceptor, has become mainstream recently because there are considerably few occurrences of ozone and nitrogen oxide and it is power-efficient.

In contact charging, the charge roll is pressed against the photoreceptor with constant pressure by a spring. When the charge roll is left in this state over a long period of time, sometimes this causes permanent distortion in the portion where the charge roll contacts the photoreceptor, as the result the charging ability changes and image defects such as density unevenness occur, or the photoreceptor and the charge roll rub against each other due to vibration and the line during transport, and image quality defects such as density unevenness occur due to damage to the charge roll.

SUMMARY

An aspect of the invention is an image carrier unit that is removably loaded into a main body of an image forming apparatus including: an image carrier on which an image is formed; a charge roll that charges the image carrier; a biasing member that causes the charge roll to be pressed against the image carrier; and a separation cover provided with a cover portion that covers the charge roll by a latching portion thereof being caused to latch into a body frame of the image carrier unit and the cover portion being rotated toward the charge roll, and a hook portion disposed on the cover portion, that is inserted between the charge roll and the image carrier and is hooked onto the charge roll when the cover portion is rotated toward the charge roll so as to cause the charge roll to separate from the image carrier.

BRIEF DESCRIPTION OF THE DRAWINGS

An exemplary embodiment of the invention will be described in detail with reference to the following figures, wherein.

DETAILED DESCRIPTION

An exemplary embodiment of an image carrier unit and an image forming apparatus pertaining to the present invention will be described below on the basis of the drawings.

Figure 1:
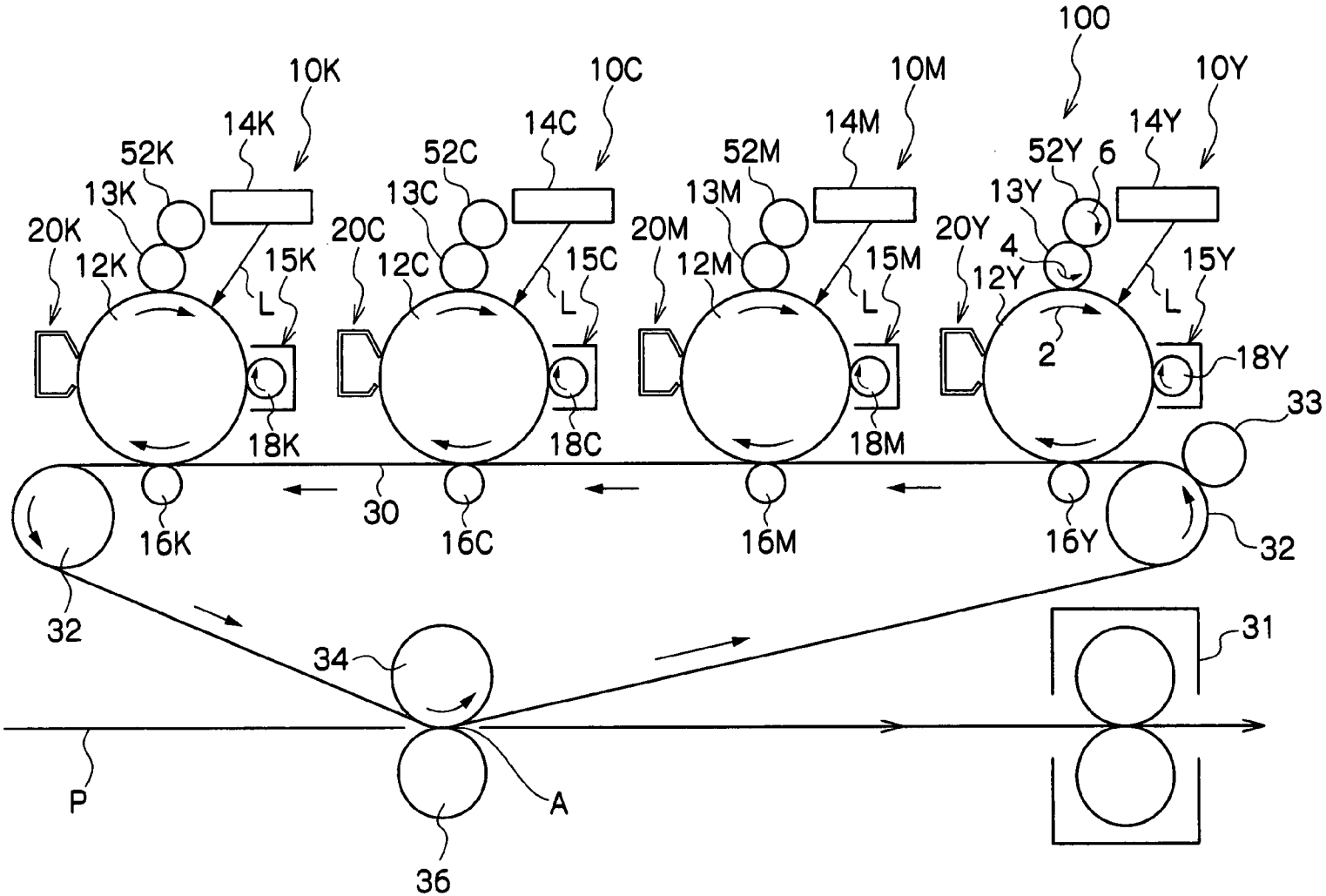
FIG. 1 is a general configural diagram showing an image forming apparatus pertaining to the embodiment of the invention.

FIG. 1 shows an image forming apparatus 100 pertaining to the exemplary embodiment of the invention.

The image forming apparatus 100 conducts image processing on the basis of color image information sent from an unillustrated image data input device such as a personal computer and forms a color image on recording paper P by the electrophotographic system.

The image forming apparatus 100 is provided with image forming units 10Y, 10M, 10C, and 10K that form toner images of the respective colors of yellow (Y), magenta (M), cyan (C), and black (K). Hereinafter, when it is necessary to distinguish between the colors of yellow, magenta, cyan, and black, the letters Y, M, C, and K will be added after reference numerals, and when it is not necessary to distinguish between the colors of yellow, magenta, cyan, and black, the letters Y, M, C, and K will be omitted.

The image forming units 10Y, 10M, 10C, and 10K are arranged in tandem in the order of the image forming unit 10Y, the image forming unit 10M, the image forming unit 10C, and the image forming unit 10K with respect to the traveling direction of an endless intermediate transfer belt 30 that is stretched by a backup roll 34 and plural stretch rolls 32. The intermediate transfer belt 30 is inserted between photoreceptor drums 12Y, 12M, 12C, and 12K that serve as image carriers of the image forming units 10Y, 10M, 10C, and 10K and first transfer rolls 16Y, 16M, 16C, and 16K that are disposed facing the photoreceptor drums 12Y, 12M, 12C, and 12K.

Next, the configuration of the image forming units 10Y, 10M, 10C, and 10K and the operation of image formation will be described by way of the image forming unit 10Y that forms the yellow toner image.

The surface of the photoreceptor drum 12Y is uniformly charged by a charge roll 13Y. Next, image exposure corresponding to the yellow image is carried out by an exposure device 14Y, whereby an electrostatic latent image corresponding to the yellow image is formed on the surface of the photoreceptor drum 12Y.

The electrostatic latent image corresponding to the yellow image is developed by toner carried on a development roll 18Y, to which a development bias of a development device 15Y is applied, and becomes a yellow toner image. The yellow toner image is primarily transferred onto the intermediate transfer belt 30 by pressure from the first transfer roll 16Y and electrostatic attraction force due to a transfer bias applied to the first transfer roll 16Y.

In this first transfer, not all of the yellow toner image is transferred to the intermediate transfer belt 30; some remains as transfer residue yellow toner on the photoreceptor drum 12Y. External additives in the toner also adhere to the surface of the photoreceptor drum 12Y. A portion after first transfer of the photoreceptor drum 12Y passes a position facing a cleaning device 20Y and the transfer residue toner on the surface of the photoreceptor drum 12Y and the like is removed. Thereafter, the surface of the photoreceptor drum 12Y is again charged by the charge roll 13Y for the next image formation cycle.

As shown in FIG. 1, in the image forming apparatus 100, the same image forming process as described above is conducted in the image forming units 10Y, 10M, 10C, and 10K at a timing in consideration of differences in the relative positions of the image forming units 10Y, 10M, 10C, and 10K, the toner images of the respective colors of yellow, magenta, cyan, and black are sequentially superposed on the intermediate transfer belt 30, and a multiple toner image is formed.

Then, the multiple toner image is transferred at once from the intermediate transfer belt 30 to the recording paper P, which is conveyed at a predetermined timing to a second transfer position A, by electrostatic attraction force of a second transfer roll 36 to which a transfer bias is applied.

The recording paper P to which the multiple toner image has been transferred is separated from the intermediate transfer belt 30 and thereafter conveyed to a fixing device 31, where the multiple toner image is fixed to the recording paper P by heat and pressure to form a full-color image.

The transfer residue toner on the intermediate transfer belt 30 that has not been transferred to the recording paper P is collected by an intermediate transfer belt cleaner 33.

Figure 2:
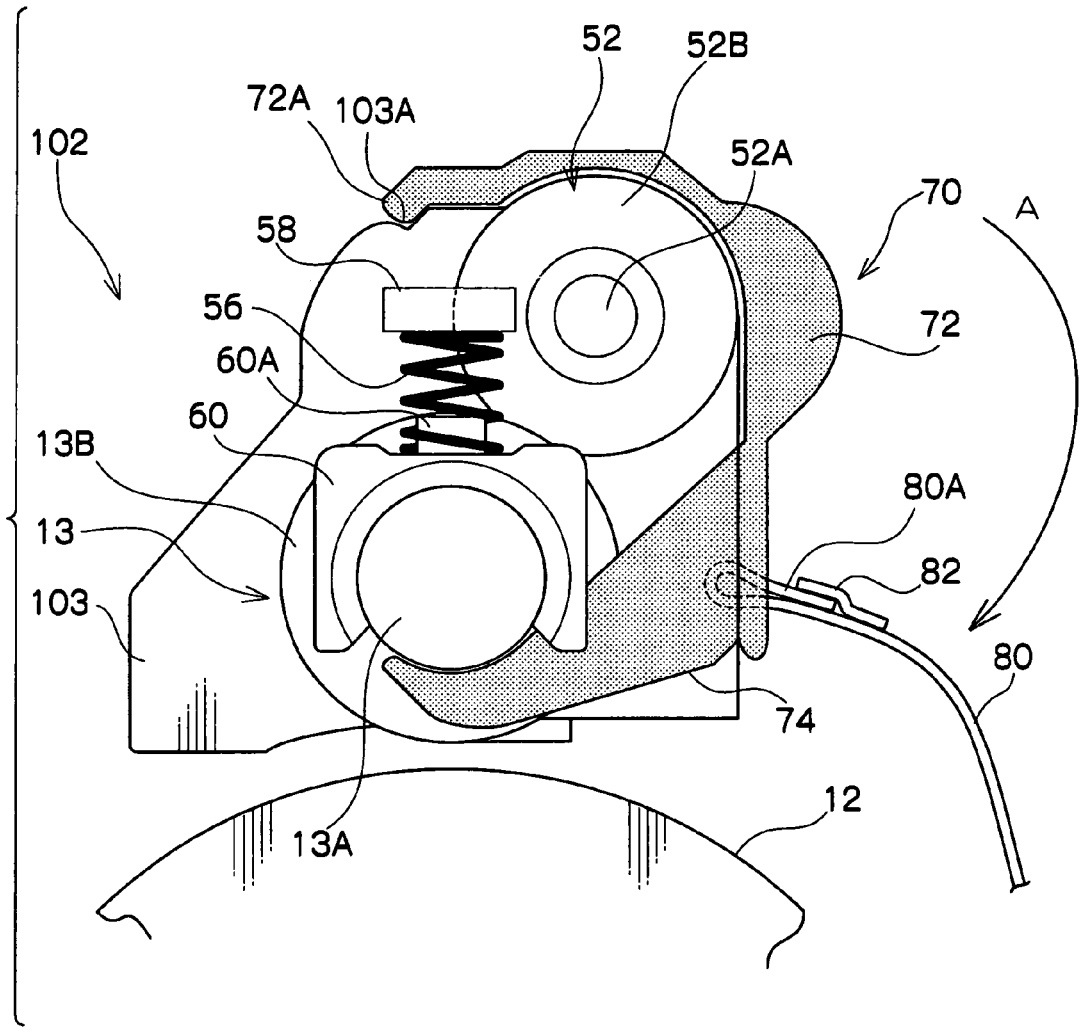
FIG. 2 is a configural diagram showing a state where, in the image forming apparatus shown in FIG. 1, a separation cover is attached to a process cartridge to separate a charge roll from a photoreceptor drum.
Figure 9:
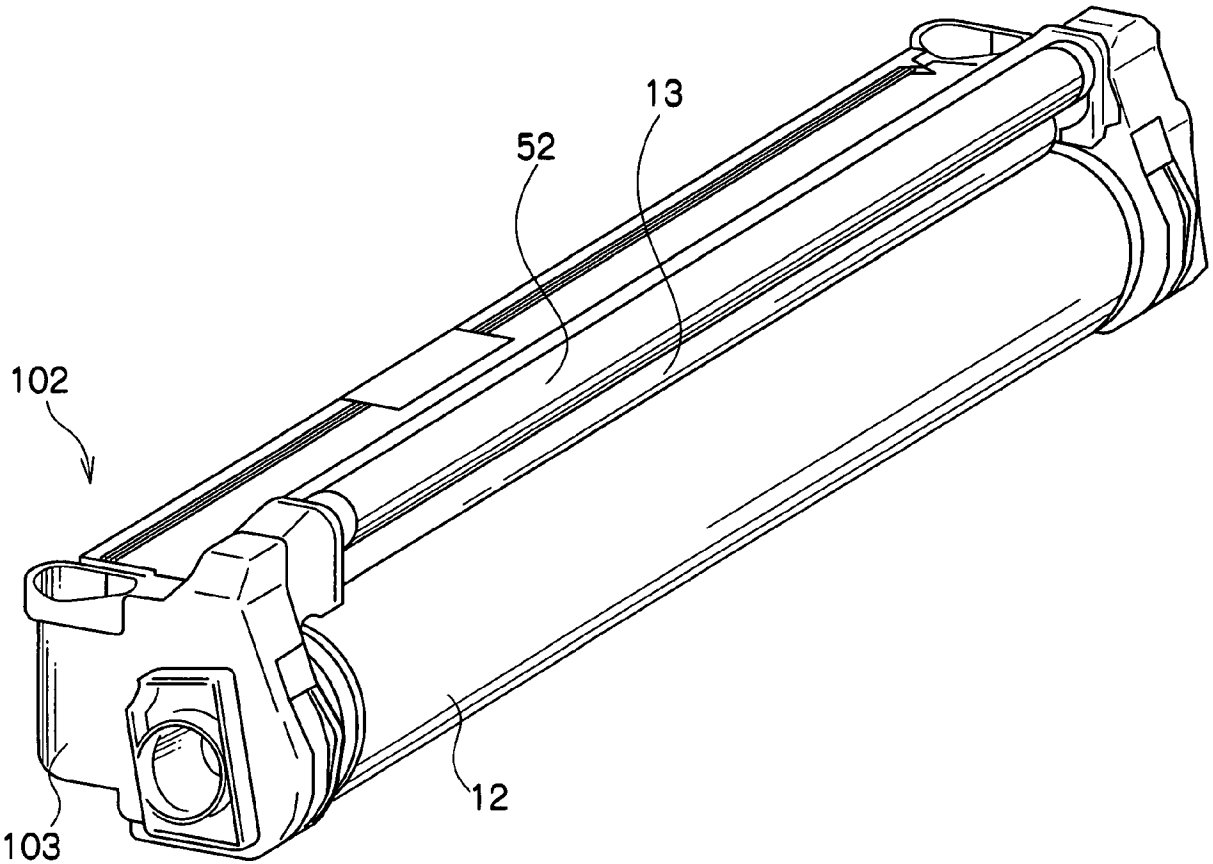
FIG. 9 is a perspective view showing a state where the packaging material and the separation cover are removed from the process cartridge.
Figure 10:
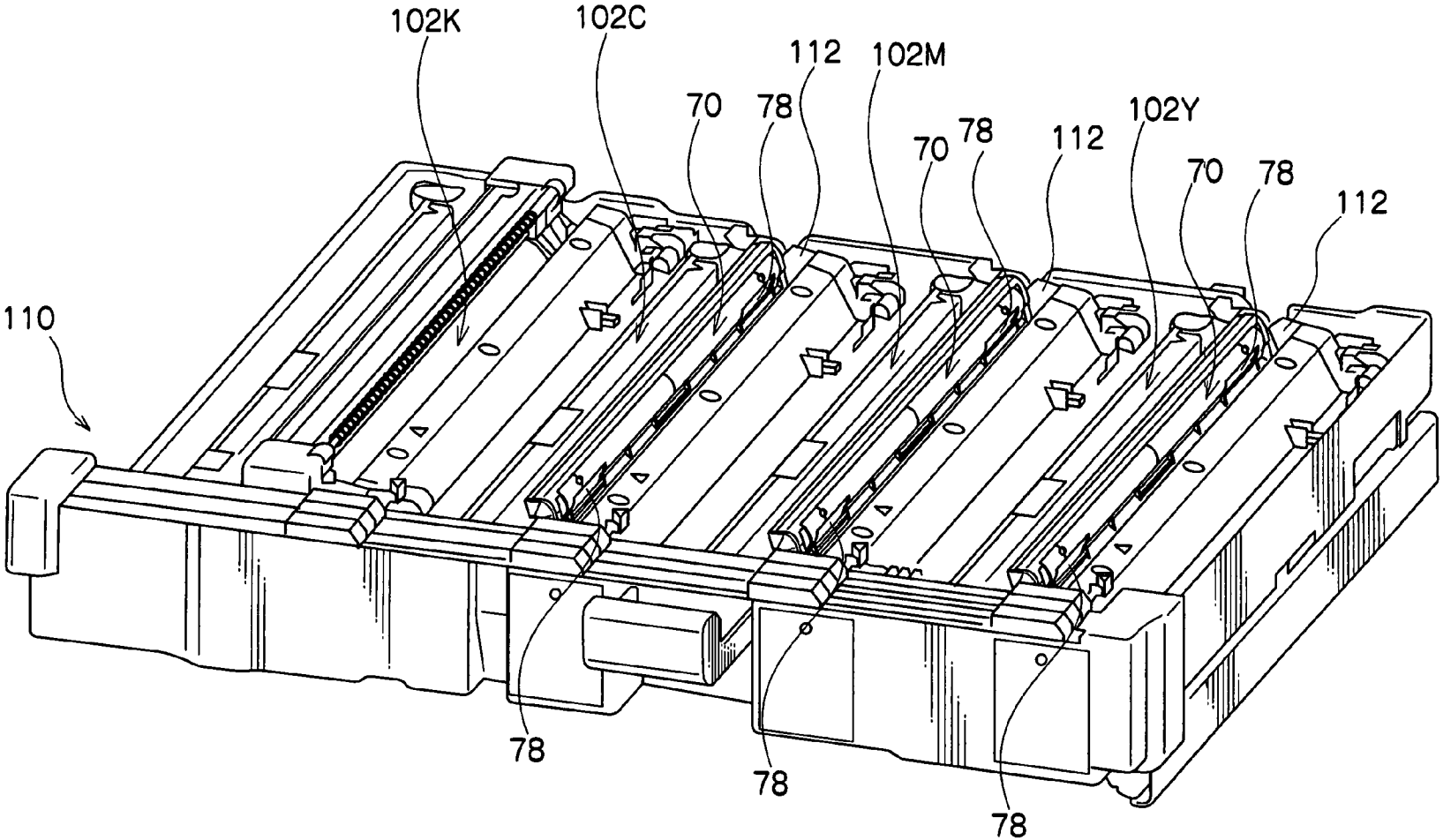
FIG. 10 is a perspective view showing a state where the process cartridge to which the separation cover is attached is removed to an image forming apparatus body.

As shown in FIG. 2 and FIG. 9, the image forming apparatus 100 includes process cartridges 102 that serve as image carrier units in which the photoreceptor drums 12, the charge rolls 13, later-described cleaning rolls 52, and the cleaning devices 20 are integrally configured. As shown in FIG. 10, four process cartridges 102Y, 102M, 102C, and 102K are disposed in correspondence to the four colors of yellow, magenta, cyan, and black, and the process cartridges 102 are removably loaded into an image forming apparatus body 110 (in FIG. 10, only part of the image forming apparatus body 110 is shown). Thus, the process cartridges 102Y, 102M, 102C, and 102K can be removed from the image forming apparatus body 110 and replaced.

Figure 3:
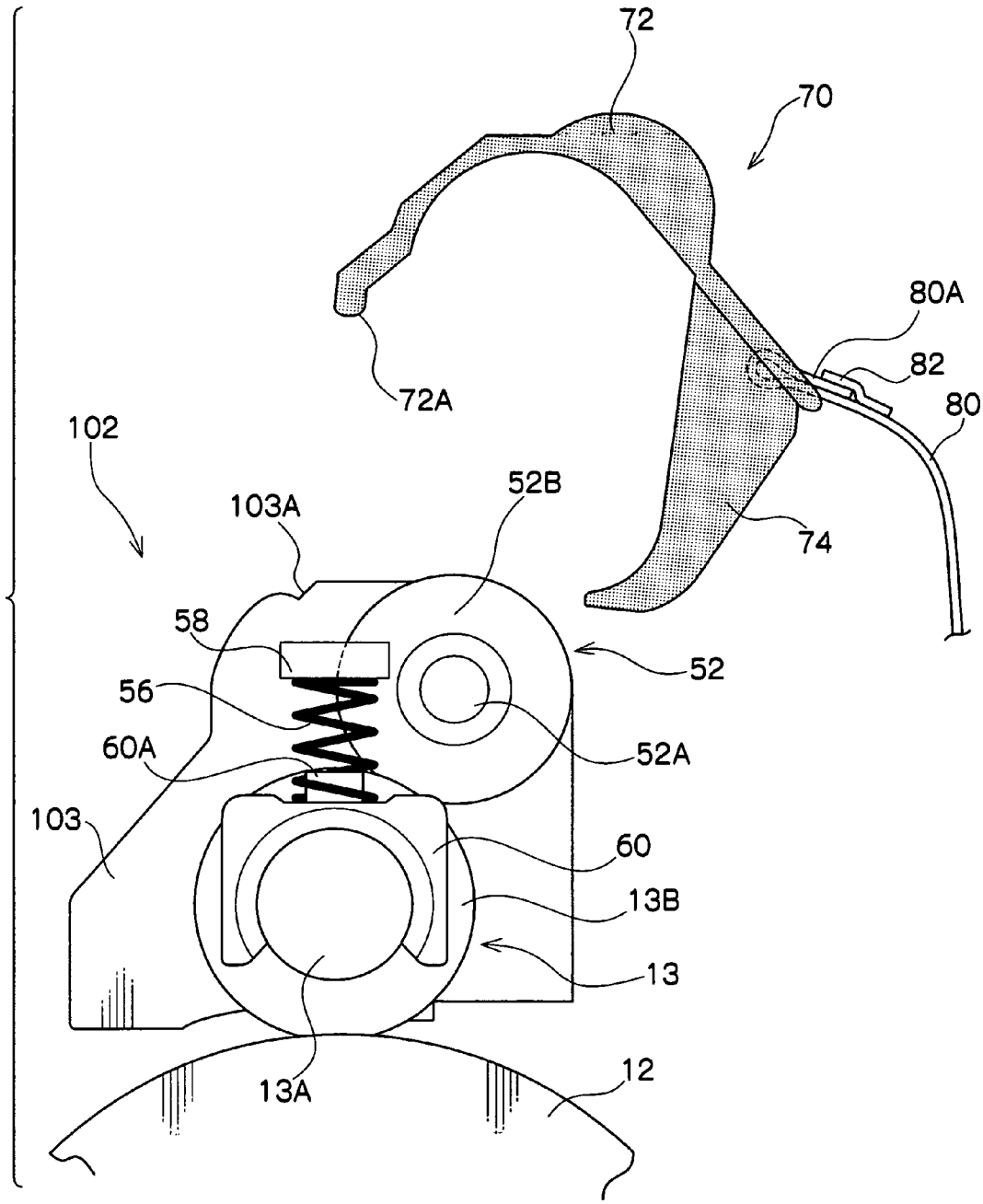
FIG. 3 is a configural diagram showing a state where, in the image forming apparatus shown in FIG. 1, the separation cover is removed from the process cartridge to allow the charge roll to press against the photoreceptor drum.

As shown in FIG. 3, the charge roll 13 is disposed above the photoreceptor drum 12 in the process cartridge 102 such that the charge roll 13 contact the photoreceptor drum 12. The charge roll 13 includes a conductive shaft 13A on whose periphery a charge layer 13B is formed. Both end portions of the shaft 13A are rotatably supported in a bearing 60 of a holder member (not shown) that is disposed such that it is slidable up and down with respect to a body frame 103 of the process cartridge 102. A compression spring 56 that biases the bearing 60 and causes the charge roll 13 to press against the photoreceptor drum 12 is disposed above the bearing 60. It will be noted that the bearing 60 includes a convex portion 60A which is inserted into the compression spring 56 to prevent the compression spring 56 from being displaced or leaning. An upper end portion of the compression spring 56 is supported on a support 58 fixed to the body frame 103.

A cleaning roll 52 that contacts the surface of the charge roll 13 is disposed above the charge roll 13 at a position adjacent to the compression spring 56. The cleaning roll 52 includes a shaft 52A on whose periphery a sponge layer 52B is formed. Both end portions of the shaft 52A are rotatably supported in the holder member (not shown). The cleaning roll 52 is pressed against the charge roll 13 with a predetermined pressure such that the sponge layer 52B is elastically deformed along the peripheral surface of the charge roll 13 and a nip portion is formed.

As shown in FIG. 2, the bearing 60, the charge roll 13, and the cleaning roll 52 are supported in the holder member (not shown) and configured to be slidable with respect to the body frame 103 in the expansion/contraction direction of the compression spring 56, that is, in the direction orthogonal to the axial direction of the photoreceptor drum 12.

Unillustrated motor is coupled to a support shaft of the photoreceptor drum 12, and the photoreceptor drum 12 is driven to rotate in the clockwise direction of FIG. 1 (the direction of arrow 2). The charge roll 13 rotates in the direction of arrow 4 following the rotation of the photoreceptor drum 12, and the cleaning roll 52 rotates in the direction of arrow 6 following the rotation of the charge roll 13. It will be noted that the charge roll 13 and/or the cleaning roll 52 may also be configured such that the charge roll 13 and/or the cleaning roll 52 is coupled to a motor and independently driven to rotate.

As shown in FIG. 2 and FIG. 3, a separation cover 70 that is detachably attached to the body frame 103 is disposed for each of the process cartridges 102. Each of the separation covers 70 is provided with a cover portion 72, which covers the charge roll 13 and the cleaning roll 52, and hook portions 74, which are disposed on an end portion of the cover portion 72 (the end portion near the charge roll 13) and hook onto the shaft 13A.

The cover portion 72 is provided with a projection 72A that latches into a groove portion 103A formed in the upper portion of the body frame 103. The cover portion 72 is curved in a right angle direction from the upper portion of the body frame 103 and is formed such that it covers the exposed portion of the cleaning roll 52 and the charge roll 13.

Figure 4:
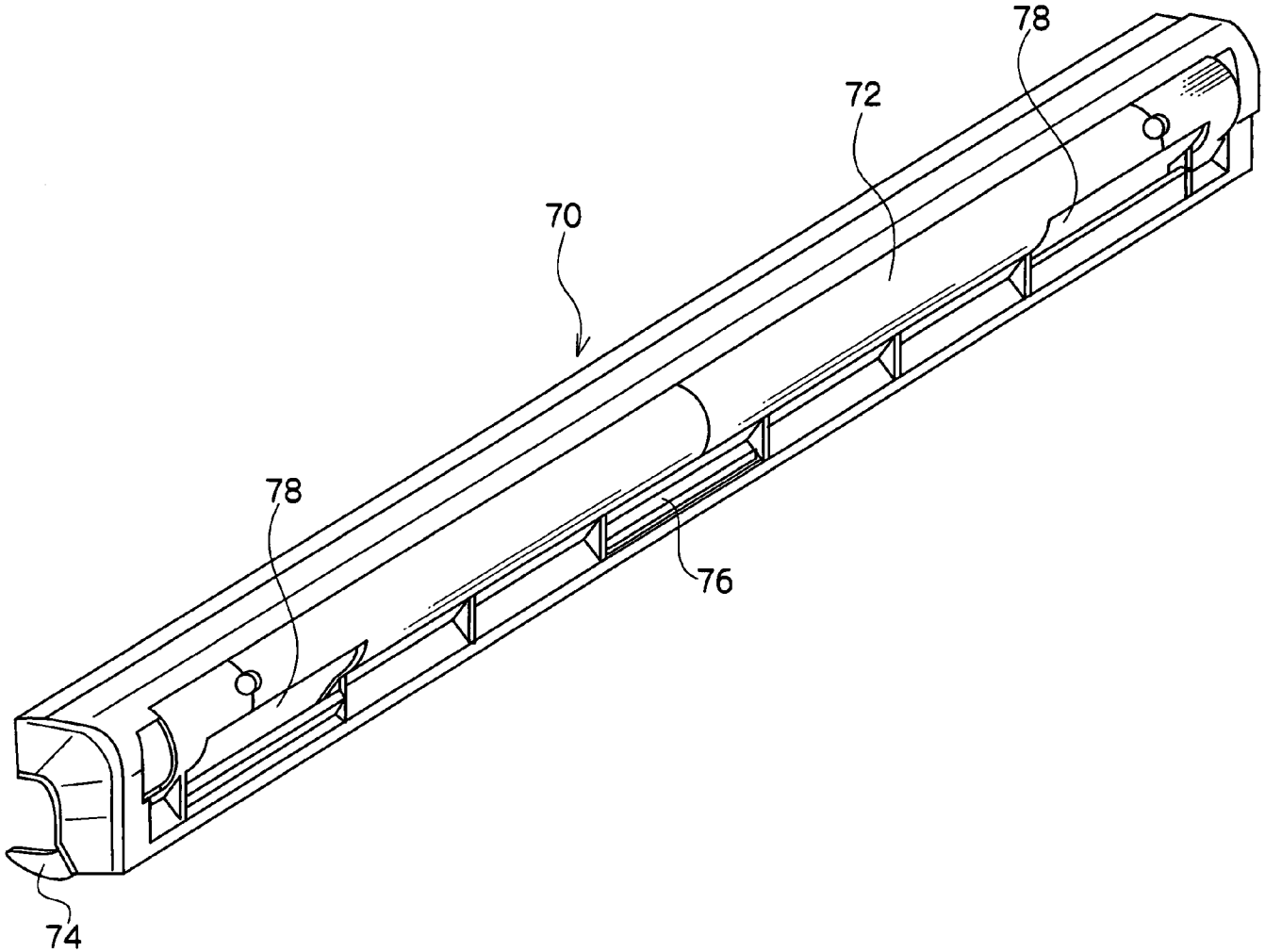
FIG. 4 is a perspective view showing the separation cover.

As shown in FIG. 4, the hook portions 74 are disposed on a lower portion (the end portion opposite from the projection 72A) of the cover portion 72 on both end portions of the cover portion 72 (in FIG. 4, just one is shown). The hook portions 74 are claw-like members that hook onto the shaft 13A and have shapes that become thinner in the rotational direction, as shown by arrow A in FIG. 2, of the cover member 72 when attaching the separation cover 70 to the body frame 103 and grow larger in the radial direction of the shaft 13A.

As shown in FIG. 2, by latching the projection 72A of the cover portion 72 into the groove portion 103A and rotating the cover portion 72 about the projection 72A as a supporting point toward the charge roll 13, the cleaning roll 52 and the charge roll 13 are covered by the cover portion 72 and the hook portions 74 become hooked onto the shaft 13A. Thus, the separation cover 70 is attached to the body frame 103 and the charge roll 13 is separated from the photoreceptor drum 12 by the hook portions 74.

As shown in FIG. 4, a slit 76 is formed, along the longitudinal direction in a center portion of the cover portion 72, at a rotational-direction end portion (the lower end portion opposite from the projection 72A) of the cover portion 72. Finger holes 78, into which a user can latch his/her fingers in order to remove the separation cover 70 from the body frame 103, are formed in both end portions of the outer surface of the cover portion 72. The cover portion 72 is formed by a resin such as POM, for example.

Figure 5:
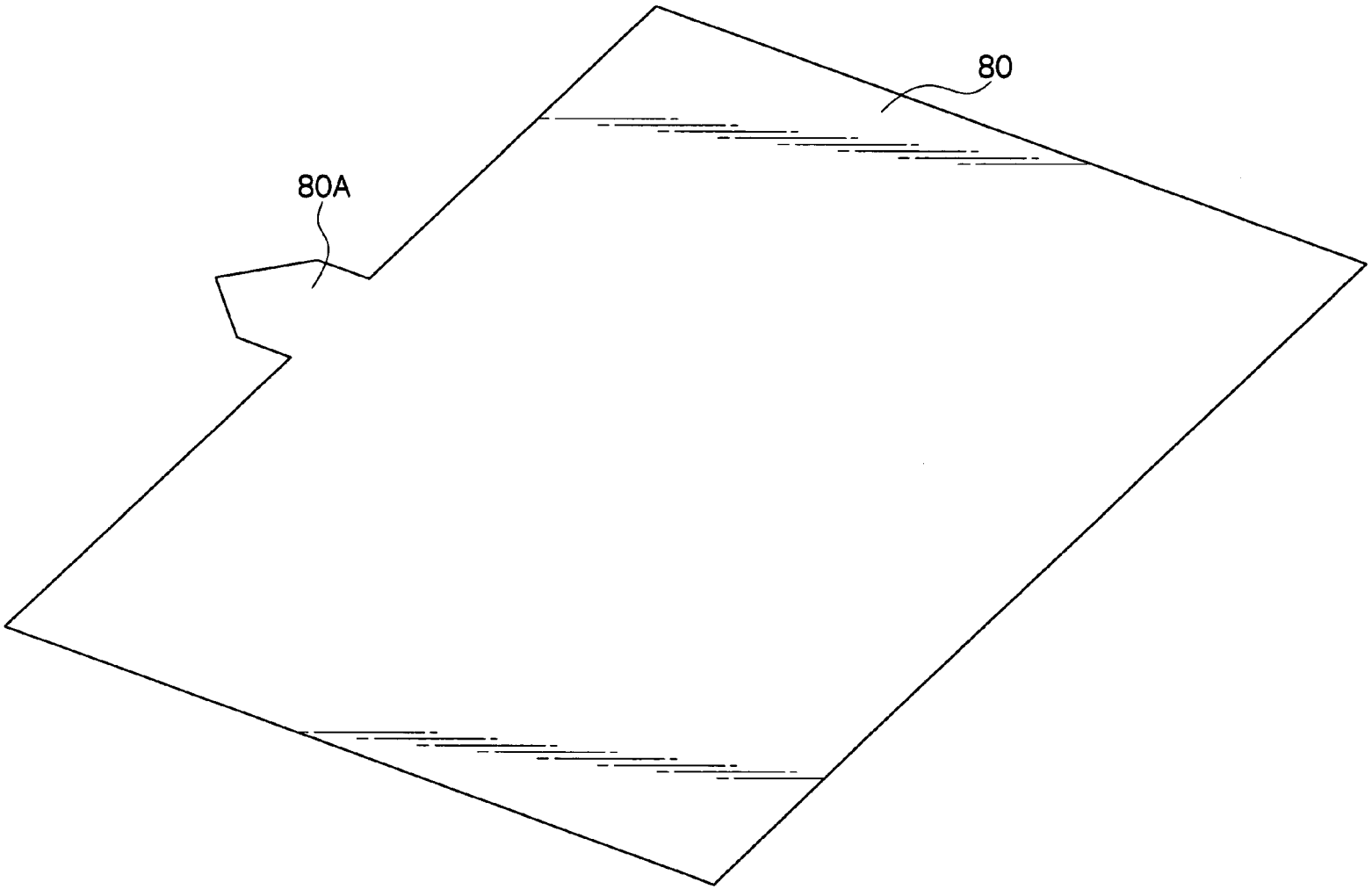
FIG. 5 is a perspective view showing a packaging material that is attached to the separation cover.
Figure 6:
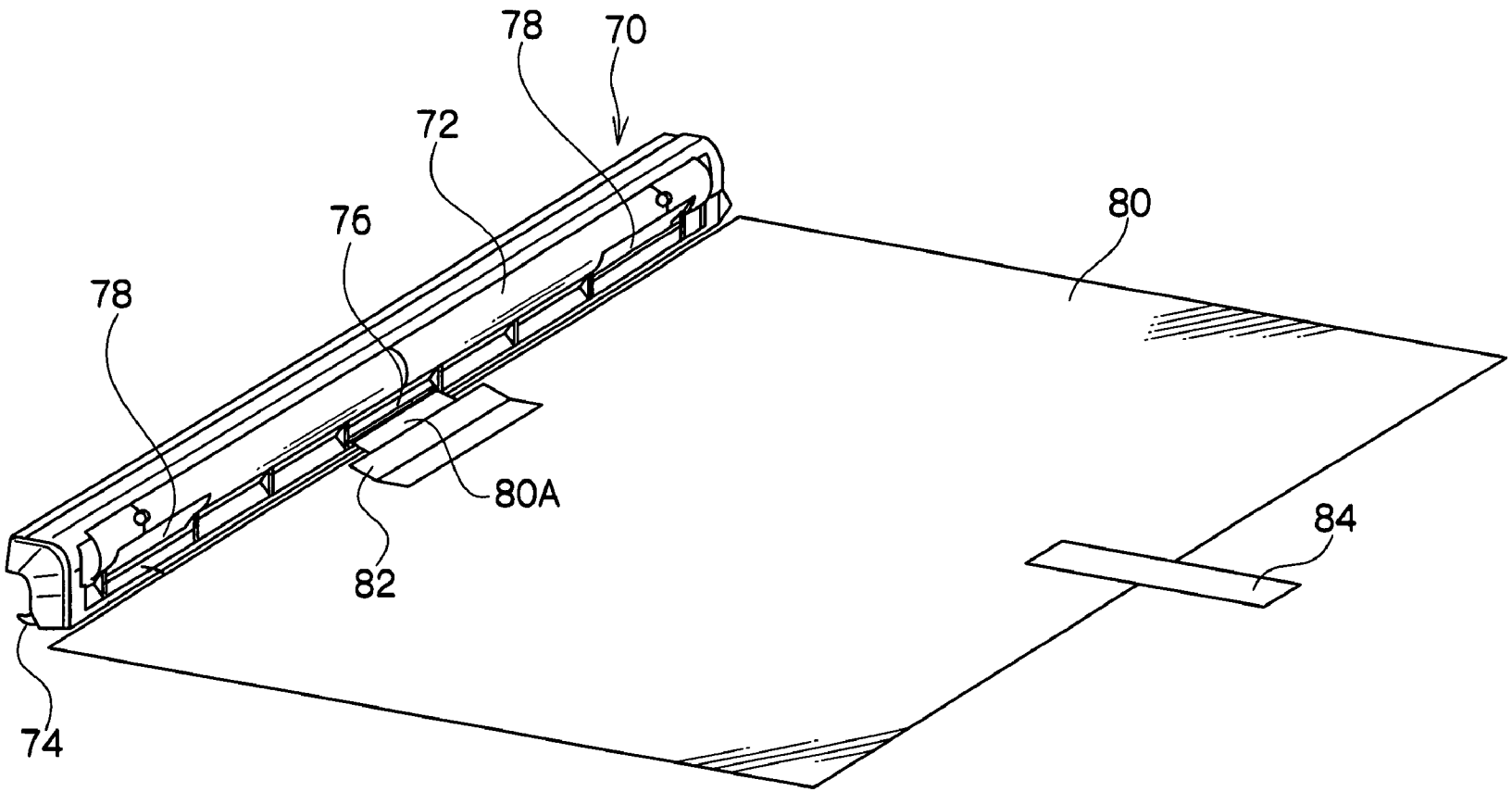
FIG. 6 is a perspective view showing a state where the packaging material is attached to the separation cover.
Figure 7:
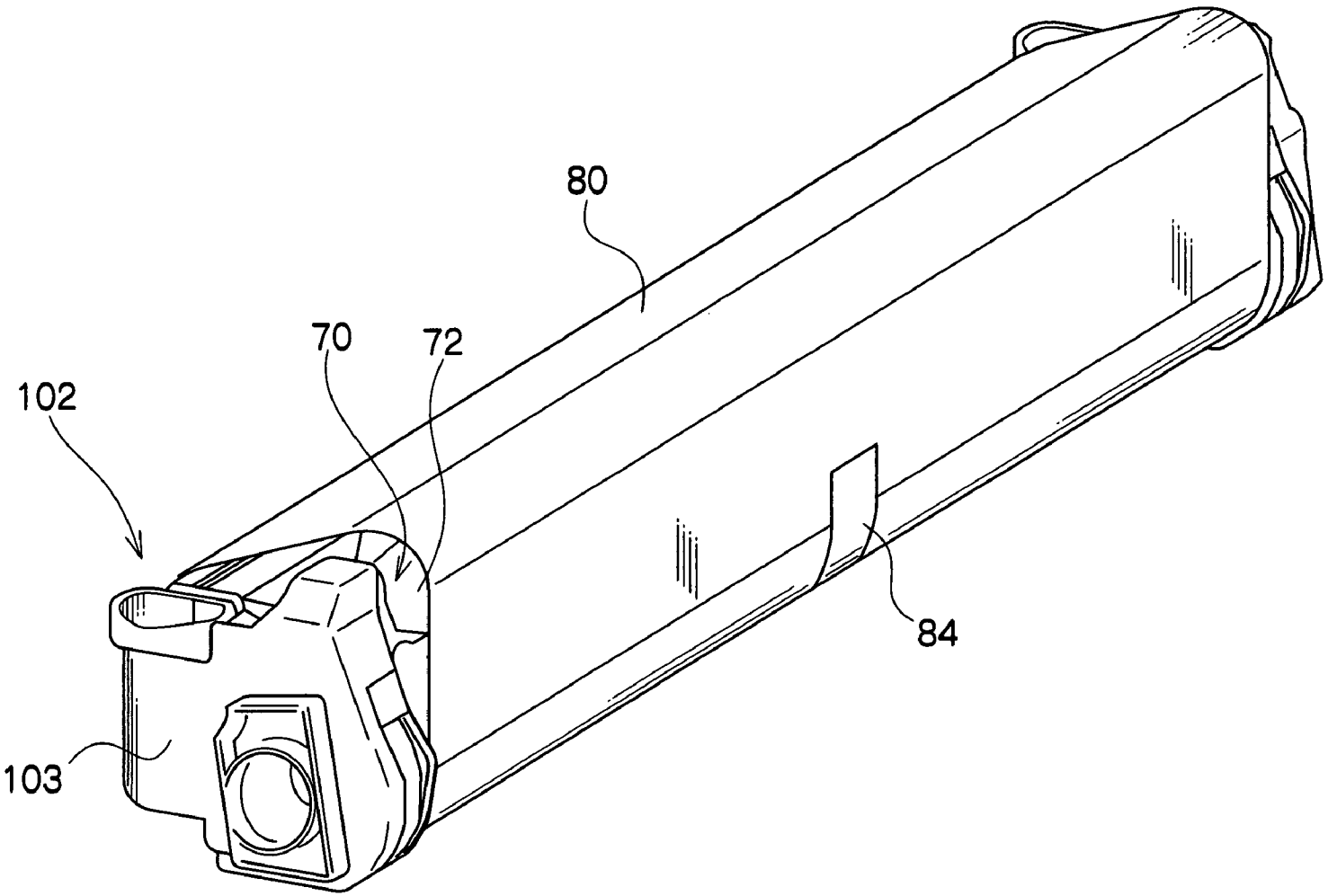
FIG. 7 is a perspective view showing a state where the separation cover is attached to the process cartridge such that the separation cover and the process cartridge are wrapped in the packaging material.

As shown in FIG. 7, the process cartridge 102 is wrapped and packaged in a light-blocking sheet-like packaging material 80. As shown in FIG. 5, the packaging material 80 is provided with a half-boat-shaped protruding piece 80A in the directional orthogonal to the longitudinal direction of the cover portion 72. As shown in FIG. 6, the packaging material 80 is coupled to the cover portion 72 by passing the protruding piece 80A through the slit 76 from the inner side of the cover portion 72, folding back the protruding piece 80A toward the surface of the packaging material 80, and adhering the folded-back protruding piece 80A to the packaging material 80 with tape 82. That is, the packaging material 80 is coupled to the cover portion 72 at one place in the center portion of the cover portion 72. Thus, packaging materials 80 of different dimensions in accordance with the length of the photoreceptor drum 12 can be attached to the separation cover 70.

When the process cartridge 102 is to be packaged after shipping inspection has been completed, as shown in FIG. 2, the projection 72A of the cover portion 72 is latched into the groove portion 103A and the cover portion 72 is rotated about the projection 72A toward the charge roll 13, whereby the cleaning roll 52 and the charge roll 13 are covered by the cover portion 72. When the cover portion 72 is rotated, the hook portions 74 are inserted between the charge roll 13 and the photoreceptor drum 12 and hook onto the shaft 13A, whereby the separation cover 70 becomes attached to the body frame 103. Because the hook portions 74 hook onto the shaft 13A, the compression spring 56 becomes compressed and the charge roll 13 is pulled upward such that the charge roll 13 no longer contacts the photoreceptor drum 12.

Further, in the separation cover 70, by adjusting the height of the projection 72A of the cover portion 72, the separation amount (lift amount) of the charge roll 13 with respect to the photoreceptor drum 12 can be adjusted. For this reason, the charge roll 13 can be reliably withdrawn from the photoreceptor drum 12 by a simple configuration. Further, the hook portions 74 have shapes that become thinner in the rotational direction of the cover member 72 when attaching the separation cover 70 to the body frame 103 and grow larger in the radial direction of the shaft 13A, and the photoreceptor drum 12 does not sustain damage because the hook portions 74 do not contact the photoreceptor drum 12. Further, the strength of the hook portions 74 can be ensured due to this shape. By hooking the hook portions 74 onto the shaft 13A, the charge roll 13 can be separated from the photoreceptor drum 12 with little space.

As shown in FIG. 7, after the separation cover 70 has been attached to the process cartridge 102, the packaging material 80 is wrapped in the rotational direction at the time of attachment of the separation cover 70 (in the direction toward the hook portions 74 from the projection 72A in FIG. 2) and the end portion of the packaging material 80 is adhered together with tape 84, whereby the process cartridge 102 is packaged. By wrapping the packaging material 80 in the rotational direction of the separation cover 70, the separation cover 70 can be prevented from coming off. The process cartridge 102 is transported and stored in this state.

By attaching the separation cover 70 to the process cartridge 102 in this manner, deformation such as permanent distortion does not occur in the peripheral surface of the charge roll 13 because the charge roll 13 is separated from the photoreceptor drum 12, for example, during storage over a long period of time. The photoreceptor drum 12 and the charge roll 13 can also be prevented from rubbing against each other due to vibration and the like during transport. For this reason, density unevenness resulting from deformation of the charge roll 13 can be suppressed. Moreover, depending on the type of charge roll 13, there are also charge rolls that use hydrophilic ions, and in particular sometime the ions leak out and emerge at the surface when the charge roll is left in a humid environment. Sometimes these adhere to the surface of the photoreceptor drum 12 and become white stripes, but in the present invention, the occurrence of such white stripes can also be prevented.

Further, because the light-blocking packaging material 80 is wrapped around the process cartridge 102, the occurrence of light-induced fatigue and damage to the photoreceptor drum 12 can be prevented, and the adhesion of foreign matter, grease and the like can be prevented.

Figure 8:
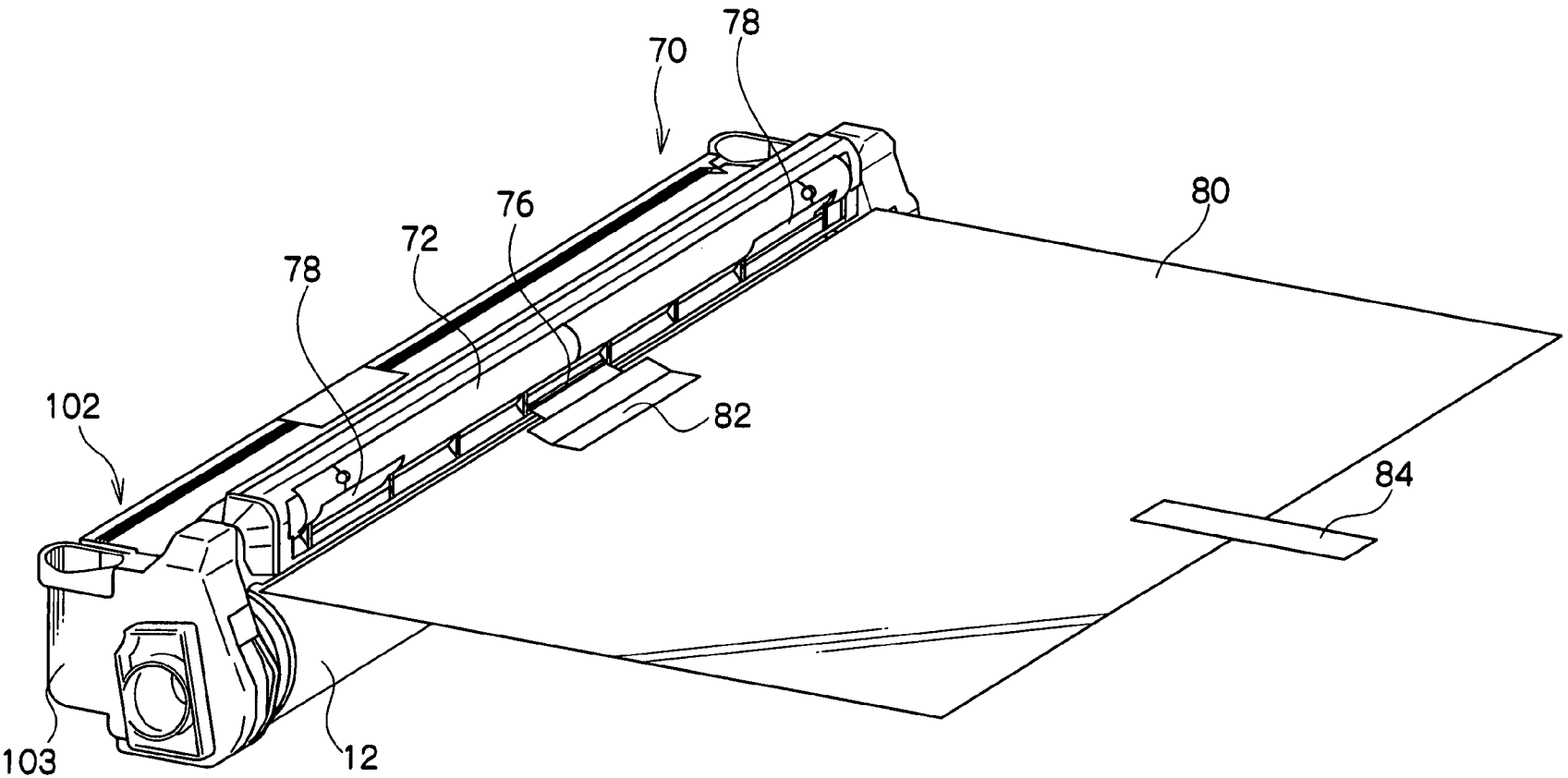
FIG. 8 is a perspective view showing a state where the packaging material is removed from the process cartridge.

The process cartridge 102 is loaded into the image forming apparatus body 110 after the packaging material 80 is removed from the process cartridge 102. As shown in FIG. 8, the tape 84 is peeled away, and the packaging material 80 is unwrapped in the direction opposite of that during packaging and is taken off of the process cartridge 102. The packaging material 80 is coupled to the end portion of the cover portion 72 which end portion opposite from the projection 72A (see FIG. 3), and by pulling the packaging material 80 as is in the direction orthogonal to the longitudinal direction of the body frame 103, the separation cover 70 rotates in the direction opposite of that during attachment and comes off of the body frame 103. By doing this, the separation cover 70 can be removed at the same time that the packaging material 80 is taken off. By removing the separation cover 70, as shown in FIG. 9, parts of the peripheral surfaces of the charge roll 13 and the cleaning roll 52 are exposed from the body frame 103. In this state, as shown in FIG. 3, the hook portions 74 come off of the shaft 13A, so that the shaft 13A moves in the direction toward the photoreceptor drum 12 by the force of the compression spring 56 and the charge roll 13 is pressed against the photoreceptor drum 12.

By integrally configuring the separation cover 70 and the packaging material 80 in this manner, charging defects resulting from forgetting to remove the separation cover 70 can be prevented, and there is no increase in the burden on the user when replacing the process cartridge 102.

Further, as shown in FIG. 10, when the separation cover 70 and the packaging material 80 are not integrally configured, or when the packaging paper 80 comes off of the separation cover 70, sometimes the separation covers 70 remain attached to the process cartridges when the process cartridges 102Y, 102M, 102C, and 102K are loaded in the image forming apparatus body 110. In this case, the user can remove the separation covers 70 by latching his/her fingers in the finger holes 78 in the separation cover 70 and pulling the separation cover 70.

Figure 11:
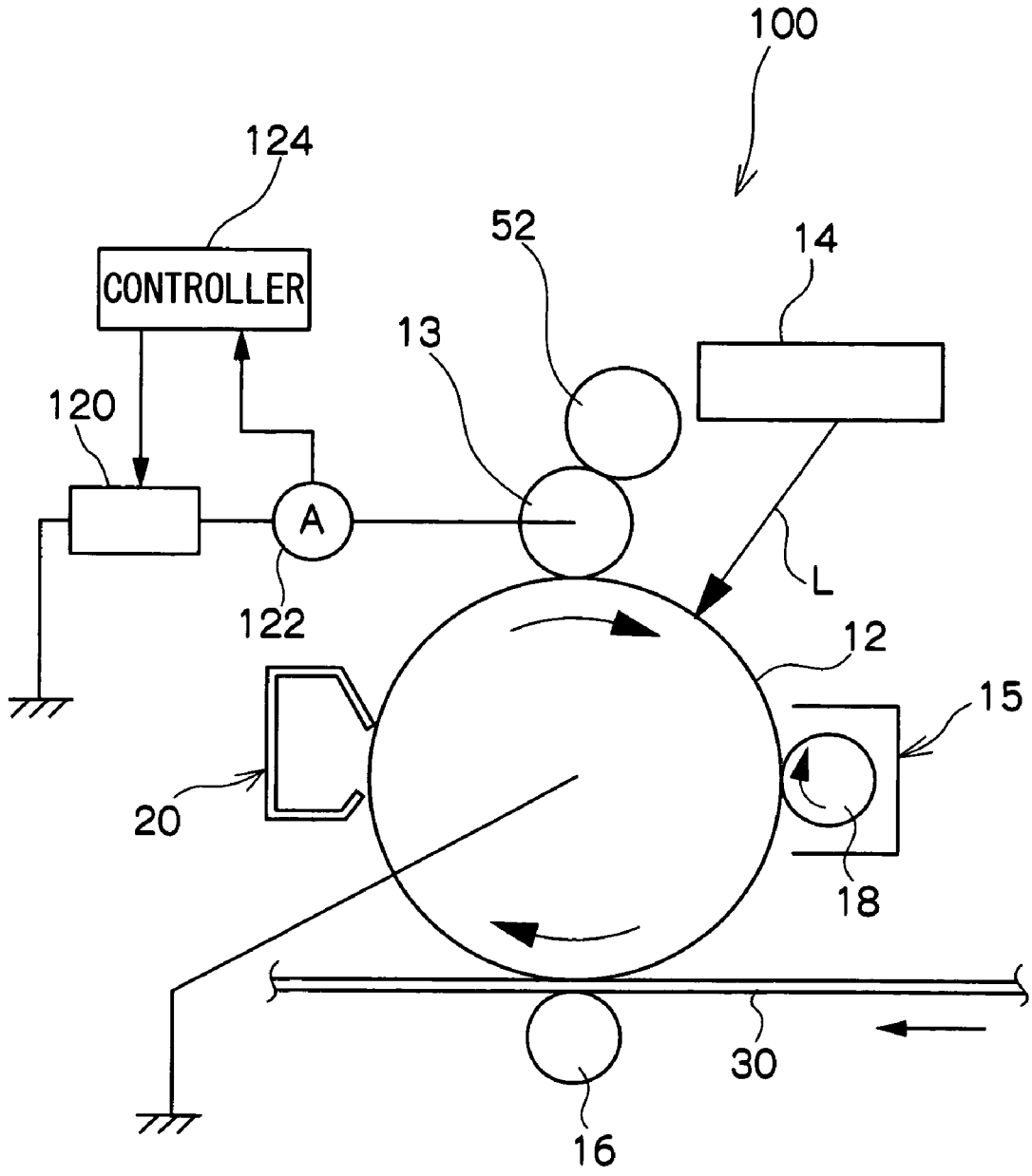
FIG. 11 is a general configural diagram showing the configuration of the vicinity of a power supply that applies high voltage to the charge roll.

As shown in FIG. 11, a power supply 120 that applies high voltage to the charge roll 13 and an ammeter 122 that measures the current value flowing from the charge roll 13 to the photoreceptor drum 12 are disposed in the image forming apparatus body 110. A controller 124 does not execute the image formation operation when the current value measured by the ammeter 122 is smaller than a predetermined value. When the separation cover 70 is attached to the process cartridge 102 and the charge roll 13 is separated from the photoreceptor drum 12, it is difficult for current to flow from the charge roll 13 to the photoreceptor drum 12. Thus, the controller 124 does not execute the image formation operation when the current value measured by the ammeter 122 is smaller than the predetermined value, so that the occurrence of drawbacks resulting from charging defects resulting from forgetting to remove the separation cover 70 can be prevented.

Figure 12:
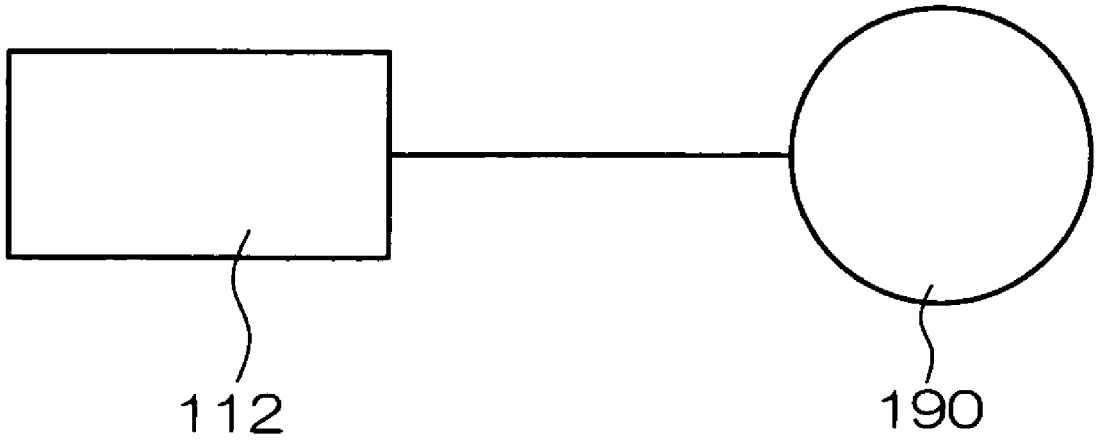
FIG. 12 is a general configural diagram showing a current detector and a plate spring.

Further, as shown in FIG. 10, the separation cover 70 may be formed by a conductive member such as conductive POM, and conductive plate spring 112 that can contact the separation cover 70 attached to the process cartridge 102 may be disposed in the image forming apparatus body 110. Further, current detector 190 shown in FIG. 12 that detects the current flowing to the plate spring 112 may be disposed in the image forming apparatus body 110. In this configuration, when high voltage is applied to the charge roll 13 in a state where the separation cover 70 is attached to the process cartridge 102, current flows to the current detector 190 from the separation cover 70 via the plate spring 112. At this time, the controller 124 does not execute the image formation operation, so that the occurrence of drawbacks resulting from charging defects resulting from forgetting to remove the separation cover 70 can be prevented.

Here, the details of the cleaning roll 52 will be described.

Free-cutting steel or stainless steel is used as the material of the shaft 52A of the cleaning roll 52. The material and surface treatment method are timely selected in accordance with the purpose, such as slidability. Material that is not conductive may be treated by a common treatment such as plating to make it conductive, or may of course be used as is. Further, because the cleaning roll 52 contacts the charge roll 13 with an appropriate nip pressure via the sponge layer 52B, a material having strength where there is little bending at the time of nipping and a shaft diameter having sufficient rigidity with respect to the shaft length are selected.

The sponge layers 52B is structured by a foam body having a porous three-dimensional structure. Cavities and concavo-convexo portions (called "cells" below) are present in the inside and surface of the sponge layer 52B so that the sponge layer 52B is elastic. The material of the sponge layer 52B is selected from a material of foam resin or rubber such as polyurethane, polyethylene, polyamide, olefin, melamine or polypropylene, NBR, EPDM, natural rubber, styrene butadiene rubber, chloroprene, silicone, or nitrile. Thus, the sponge layer 52B that includes numerous cells can be manufactured inexpensively. Further, polyurethane, which has strong tearing strength and strong tensile strength, is particularly preferably used for the sponge layer 52B in order to ensure that the sponge layer 52B effectively cleans foreign matter such as the external additives by following the rotation of the charge roll 13 and rubbing the charge roll 13, that the surface of the charge roll 13 is not damaged by the rubbing of the sponge layer 52B, and that breakage and damage do not occur over a long period of time.

The polyurethane is not particularly limited. It suffixes for there to be an accompaniment of a reaction of a polyol such as polyester polyol, polyether polyester, or acrylic polyol, and an isocyanate such as 2,4-tolylenediisocyanate, 2,6-tolylenediisocyanate, 4,4-diphenylmethane diisocyanate, tolidine diisocyanate, or 1,6-hexamethylene diisocyanate, and it is preferable that a chain extender such as 1,4-butanediol or trimethylolpropane is to be mixed in. Further, it is common to cause foaming using water and a foaming agent such as an azo compound like azodicarbonamide or azobisisobutyronitrile. Moreover, auxiliaries such as a foaming accelerator, a foam adjusting agent, and a catalyst may also be added as needed.

It is preferable for the number of cells in the sponge layer 52B of the cleaning roll 52 to be 40 to 80 cells per 25 mm, and more preferable for the number of cells to be 45 to 75 cells per 25 mm. By setting the number of cells to this range, it becomes easier for foreign matter such as toner and the external additives to be collected inside the cells and easier to transfer the collected foreign matter such as the external additives to the charge roll 13 and the photoreceptor drum 12. When the number of cells is greater than 80 cells per 25 mm, the ability to collect the external additives drops because the cell diameters are small. Conversely, when the number of cells is less than 40 cells per 25 mm, the cell diameters become too large and it becomes difficult to consolidate the collected external additives to an appropriate size that can be transferred to the charge roll 13.

Further, the diameter of the cleaning roll 52 is preferably ϕ7 mm to ϕ14 mm and more preferably ϕ8 mm to ϕ13 mm. It is preferable for the thickness of the sponge layer 52B to be 2 mm to 4 mm. When the diameter is equal to or greater than 14 mm, the number of times that the cleaning roll 52 contacts the external additives per one place on the peripheral surface of the cleaning roll 52 decreases and the number of times of cleaning decreases. Thus, even though there is excellent prolonged stability with respect to cleaning performance, this is disadvantageous from the standpoint of making the image forming apparatus compact. When the diameter is equal to or less than 7 mm, this is advantageous because the image forming apparatus can be made compact, but it becomes disadvantageous with respect to prolonged stability because the number of times that the cleaning roll 52 contacts the external additive per one place on the peripheral surface of the cleaning roll 52 increases and the number of times of cleaning increases.

Next, the details of the charge roll 13 will be described.

Each of the charge rolls 13 is structured with the conductive shaft 13A on which a conductive elastic layer and a surface layer are sequentially formed as the charge layer 13B.

The diameter of the charge roll 13 is preferably ϕ7 mm to ϕ15 mm and more preferably ϕ8 mm to ϕ14 mm. It is preferable for the thickness of the charge roll 13 to be 2 mm to 4 mm. When the diameter is equal to or greater than 15 mm, the number of times that the charge roll 13 contacts the external additives per one place on the peripheral surface of the charge roll 13 decreases and the number of times of discharge decreases. Thus, even though there is excellent prolonged stability with respect to contamination and charging performance, this is disadvantageous from the standpoint of making the image forming apparatus compact. When the diameter is equal to or less than 7 mm, this is advantageous because the image forming apparatus can be made compact, but it becomes disadvantageous with respect to prolonged stability because the number of times that the charge roll 13 contacts the external additive per one place on the peripheral surface of the charge roll 13 increases and the number of times of discharge increases.

It goes without saying that the charge roll 13 is not limited to the following configuration as long as it has predetermined charging performance.

Free-cutting steel or stainless steel is used as the material of the shaft 13A. The material and surface treatment method are timely selected in accordance with the purpose, such as slidability. Material that is not conductive may be treated by a common treatment such as plating to make it conductive.

The conductive elastic layer configuring the charge layer 13B of the charge roll 13 includes an elastic material such as rubber and a conductive material such as carbon black or an ion conductive material that adjusts the resistance of the conductive elastic layer. Materials that can ordinarily be added to rubber—such as a softening agent, a plasticizing agent, a hardening agent, a vulcanizing agent, a vulcanization accelerating agent, an anti-aging (deterioration) agent, and a filling agent such as silica and calcium carbonate—may also be added as needed. The charge layer 13B is formed by covering the peripheral surface of the conductive shaft 13A with a mixture to which materials ordinarily added to rubber have been added. A conductive agent in which a material that conducts electricity using electrons and/or ions as charge carriers is dispersed—such as carbon black arranged in a matrix material or an ion conductive agent—can be used as a conductive agent for the purpose of adjusting the resistance. Further, the elastic material may be a foam body.

The elastic material configuring the conductive elastic layer is formed by dispersing the conductive agent in rubber material, for example. Examples of the rubber material include isoprene rubber, chloroprene rubber, epichlorohydrin rubber, butyl rubber, urethane rubber, silicone rubber, fluoro-rubber, styrene-butadiene rubber, butadiene rubber, nitrile rubber, ethylene-propylene rubber, epichlorohydrin-ethyleneoxide copolymer rubber, epichlorohydrin-ethyleneoxide-allyl glycidyl ether copolymer rubber, ethylene propylene diene three-polymer (EPDM) rubber, acrylonitrilebutadiene copolymer rubber, natural rubber, and blend rubbers thereof. Among these, silicone rubber, ethylene-propylene rubber, epichlorohydrin-ethyleneoxide copolymer rubber, epichlorohydrin-ethyleneoxide-allyl glycidyl ether copolymer rubber, acrylonitrilebutadiene copolymer rubber, and blend rubbers thereof are preferably used. These rubbers may be foaming or non-foaming.

An electron conductive agent or an ion conductive agent is used as the conductive agent. Examples of the electron conductive agent include micropowder such as: carbon black such as ketjenblack and acetylene black; pyrolytic carbon, graphite; various types of conductive metals and alloys such as aluminium, copper, nickel, and stainless steel; various types of conductive metal oxides such as tin oxide, indium oxide, titanium oxide, a solution of tin oxide and antimony oxide, and a solution of tin oxide and indium oxide; and insulating substances whose surfaces have been treated to make them conductive. Further, examples of the ion conductive agent include perchlorates and chlorates such as tetraethylammonium and lauryl trimethyl ammonium; and perchlorates and chlorates of alkali earth metals and alkali metals such as lithium and magnesium.

The surface layer configuring the charge layer 13B is formed in order to prevent contamination by foreign matter such as toner. The material of the surface layer is not particularly limited; resin or rubber, for example, may be used. Examples include polyester, polyimide, copolymer nylon, silicone resin, acrylic resin, polyvinyl butyral, ethylene-tetrafluoroethylene copolymer, melamine resin, fluoro-rubber, epoxy resin, polycarbonate, polyvinyl alcohol, cellulose, polyvinylidene chloride, vinyl chloride, polyethylene, and ethylene vinyl-acetate copolymer. Polyvinylidene fluoride, polytetrafluoroethylene copolymer, polyester, polyimide, and copolymer nylon are preferably used from the standpoint of external additive contamination.

Further, a conductive material can be added to the surface layer to adjust the resistance. It is preferable for the conductive material to be one whose particle diameter is 3 μm or less. Further, a conductive agent in which is dispersed a material that conducts electricity using electrons and/or ions as charge carriers—such as carbon black arranged in a matrix material, conductive metal oxide particles, or an ion conductive agent—can be used as a conductive agent for the purpose of adjusting the resistance.

Further, fluorine or silicone resin is used in the surface layer. In particular, it is preferable for the resin to be configured by a fluorine denaturation acrylate polymer. Microparticles may also be added to the surface layer. Thus, by adding microparticles, the surface layer becomes hydrophobic and the adherence of foreign matter to the charge roll 13 is prevented. It is also possible to add insulating particles such as alumina or silica to impart unevenness to the surface of the charge roll 13, thus, it is possible to reduce the burden when the surface layer rubs the photoreceptor drum 12, and improve abrasion resistance between the charge roll 13 and the photoreceptor drum 12.

In the image forming apparatus 100 with this configuration, as shown in FIG. 1, toner and external additives (Si, Ti, etc.) adhering to the surface of the photoreceptor drum 12 after passing the cleaning device 20 adhere to the surface of the charge roll 13. The toner and external additives adhering to the surface of the charge roll 13 are collected inside the cells of the sponge layer 52B at the nip portion between the charge roll 13 and the cleaning roll 52. In the nip portion between the charge roll 13 and the cleaning roll 52, compression and expansion occurs inside the cells and at the surface of the sponge layer 52B, and a phenomenon occurs which scrapes off the toner and external additives and causes them to clump together. Then, when the toner and external additives clump together and become a certain size or greater, the "clump" is returned to the charge roll 13 from the cell in the sponge layer 52B of the cleaning roll 52. Moreover, the clump is returned to the photoreceptor drum 12 from the surface of the charge roll 13, and thereafter the clump on the surface of the photoreceptor drum 12 is collected by the cleaning device 20 and the development roll 18 of the development device 15. Further, clump that has moved from the photoreceptor drum 12 to the intermediate transfer belt 30 is collected by the intermediate transfer belt-use cleaner 33 of the intermediate transfer belt 30. Cleaning performance is maintained as a result of this series of operations being repeated.

In this image forming apparatus 100, the separation cover 70 that brings the charge roll 13 out of contact with the photoreceptor drum 12 is attached at the time of the shipment of the process cartridge 102. For this reason, permanent deformation of the charge roll 13, and rubbing of the photoreceptor drum 12 and the charge roll 13 due to vibration at the time of transport, is controlled, and image quality defects such as density unevenness can be prevented.

Further, because the separation cover 70 and the packaging material 80 are integrally configured, the separation cover 70 can be removed from the process cartridge 102 when the packaging material 80 is removed. For this reason, carrier spill inside the development device 15 resulting from charging defects when a user has forgotten to remove the separation cover 70 can be prevented.

Further, because the separation cover 70 can be removed when the packaging material 80 is removed, there is no increase in the burden on the user when replacing the process cartridge 102.

The image forming apparatus 100 of the preceding embodiment is configured such that the charge roll 13 is brought into contact with the upper portion of the photoreceptor drum 12 and the cleaning rolls 52 is brought into contact with the upper portion of the charge roll 13, but the present invention is not limited to this configuration. For example, the present invention can also be applied to a configuration where the charge roll is brought into contact with the lower portion of the photoreceptor drum and the cleaning roll is brought into contact with the lower portion of the charge roll.

The image forming apparatus 100 is configured such that the image forming units 10Y, 10M, 10C, and 10K of yellow, magenta, cyan, and black are arranged in a row along the moving direction of the intermediate transfer belt 30, but the present invention is not limited to this configuration. For example, even in a configuration that uses a rotary developer to repeat in four cycles the formation of toner images on photoreceptor drum, the present invention can also be applied to a process cartridge provided with a photoreceptor drum, a charge roll, and a cleaning roll.

The foregoing description of the exemplary embodiment has been provided for the purposes of illustration and description. It is not intended to be exhaustive or to limit the invention to the precise forms disclosed. Obviously, many modifications and variations will be apparent to practitioners skilled in the art. The exemplary embodiment are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image carrier unit that is removably loaded into a main body of an image forming apparatus, comprising:

an image carrier on which an image is formed;

a charge roll that charges the image carrier;

a biasing member that causes the charge roll to be pressed against the image carrier; and a separation cover provided with a cover portion that covers the charge roll by a latching portion thereof being caused to latch into a body frame of the image carrier unit, the cover portion being rotated toward the charge roll, and a hook portion disposed on the cover portion, that is inserted between the charge roll and the image carrier and is hooked onto the charge roll when the cover portion is rotated toward the charge roll so as to cause the charge roll to separate from the image carrier.

2. The image carrier unit of claim 1, wherein a sheet-shaped packaging material is attached to the separation cover, and the separation cover is attached to the body frame and the packaging material is wrapped around the image carrier unit in rotational direction of the cover portion to package the image carrier unit.

3. The image carrier unit of claim 1, wherein a separation amount of the charge roll with respect to the image carrier is adjusted by a height of the latching portion of the separation cover.

4. The image carrier unit of claim 1, wherein the separation cover is formed by a conductive member.

5. The image carrier unit of claim 1 further comprising a cleaning member that cleans the charge roll, wherein the separation cover also covers the cleaning member.

6. The image carrier unit of claim 1, wherein the outer surface of the separation cover includes a finger hole for removing the separation cover from the body frame.

7. The image carrier unit of claim 2, wherein a protruding piece is formed in a center of an end portion of the packaging material, and the protruding piece is inserted through and coupled with a hooking hole formed in a center portion of the cover portion further in the rotational direction than the latching portion.

8. An image forming apparatus comprising an image carrier unit that is removably loaded into a main body of an image forming apparatus, the image carrier unit comprising: an image carrier on which an image is formed; a charge roll that charges the image carrier; a biasing member that causes the charge roll to be pressed against the image carrier; and a separation cover provided with a cover portion that covers the charge roll by a latching portion thereof being caused to latch into a body frame of the image carrier unit, the cover portion being rotated toward the charge roll, and a hook portion disposed on the cover portion, that is inserted between the charge roll and the image carrier and is hooked onto the charge roll when the cover portion is rotated toward the charge roll so as to cause the charge roll to separate from the image carrier, the image carrier unit being loaded into the main body of the image forming apparatus after the separation cover is removed.

9. An image forming apparatus comprising:

an image carrier unit that is removably loaded into a main body of an image forming apparatus, comprising: an image carrier on which an image is formed; a charge roll that charges the image carrier; a biasing member that causes the charge roll to be pressed against the image carrier; and a separation cover provided with a cover portion that covers the charge roll by a latching portion thereof being caused to latch into a body frame of the image carrier unit, the cover portion being rotated toward the charge roll, and a hook portion disposed on the cover portion, that is inserted between the charge roll and the image carrier and is hooked onto the charge roll when the cover portion is rotated toward the charge roll so as to cause the charge roll to separate from the image carrier; and, an ammeter that measures a current value of the charge roll, the image forming apparatus not executing an image formation operation when the current value measured by the ammeter is smaller than a predetermined value.

10. An image forming apparatus comprising an image carrier unit that is removably loaded into a main body of an image forming apparatus, the image carrier unit comprising: an image carrier on which an image is formed; a charge roll that charges the image carrier; a biasing member that causes the charge roll to be pressed against the image carrier; and a separation cover, formed by a conductive member, provided with a cover portion that covers the charge roll by a latching portion thereof being caused to latch into a body frame of the image carrier unit, the cover portion being rotated toward the charge roll, and a hook portion disposed on the cover portion, that is inserted between the charge roll and the image carrier and is hooked onto the charge roll when the cover portion is rotated toward the charge roll so as to cause the charge roll to separate from the image carrier, the image forming apparatus not executing an image formation operation when a current detector of the main body of the image forming apparatus detects that current flows at the separation cover.

11. The image carrier unit of claim 1, wherein the hook portions are provided at end portions of the cover portion, and are hooked onto end portions of a rotation shaft of charge roll.

12. The image carrier unit of claim 1, wherein a groove portion is formed at the body frame of the image carrier unit, and the latching portion of the cover portion is latched into the groove portion.

13. The image forming apparatus of claim 10, wherein a conductive member that can contact the separation cover attached to the image carrier unit is provided in the main body of the image forming apparatus, and the image forming apparatus does not execute an image formation operation when the current detector detects that current flows at the conductive member which contacts the separation cover.

* * * * *